United States Patent [19]

Bormann et al.

[11] Patent Number: 5,012,746

[45] Date of Patent: May 7, 1991

[54] CONVEYING DEVICE

[75] Inventors: Uwe Bormann, Rümmingen; Ekkehard Matzko, Neu-Ulm; Dieter Görner, Hausen, all of Fed. Rep. of Germany

[73] Assignee: Wampfler GmbH, Weil am Rheim-Markt, Fed. Rep. of Germany

[21] Appl. No.: 474,947

[22] Filed: Feb. 5, 1990

[30] Foreign Application Priority Data

Feb. 10, 1989 [DE] Fed. Rep. of Germany ..... 3903949

[51] Int. Cl.[5] ..... B61B 3/00

[52] U.S. Cl. ..... 104/93; 104/107

[58] Field of Search ..... 104/89, 93, 106, 107, 104/109, 111, 159; 198/345.3, 465.2, 465.4, 860.2, 861.1; 238/122, 134; 191/45, 50

[56] References Cited

U.S. PATENT DOCUMENTS

| | | | |
|---|---|---|---|
| 1,816,031 | 7/1931 | Willis | 104/93 |
| 2,821,146 | 1/1958 | Mahrle et al. | 104/95 |
| 3,043,408 | 7/1962 | Attwood | 104/107 X |
| 3,315,778 | 4/1967 | Kendall et al. | 198/345.3 X |
| 3,345,471 | 10/1967 | Kilburg | 104/93 X |
| 3,935,822 | 2/1976 | Kaufmann | 104/93 |
| 3,954,065 | 5/1976 | te Velde et al. | 104/89 X |
| 4,423,685 | 1/1984 | Kerckhoff | 104/93 X |
| 4,671,183 | 6/1987 | Fujita et al. | 104/93 |

*Primary Examiner*—Robert J. Oberleitner
*Assistant Examiner*—S. Joseph Morano
*Attorney, Agent, or Firm*—Pascal & Associates

[57] ABSTRACT

A conveying system comprised of a rail and at least one transport hanger which can travel back and forth along the rail on rollers, the rollers having horizontal axes of rotation, the rail having horizontal conveyer support projections which are located at the bottom of the rail and along which the rollers are positioned for travel back and forth along the rail carrying the transport hanger with them, trolley wires which are insulated from one another being located on the rail to the side of the path of motion of the transport hanger, the rail having guideways for rollers of a trolley carriage at the side of the path of motion of the transport hanger for facilitating support and movement of the trolley carriage back and forth at the side of the transport hanger and independently thereof, the trolley carriage having sliding contacts for engagement of the trolley wires for powering a tool that may be carried by the trolley carriage.

15 Claims, 2 Drawing Sheets

CONVEYING DEVICE

BACKGROUND OF THE INVENTION

This invention relates to a conveying device of the type having a transport hanger that can travel back and forth on rollers along a rail.

Conveying systems for transport hangers are known in which the rails have a C-shaped profile which is open toward the bottom. In this form of conveying system the rollers of the transport hanger run on the lower opposite flanks of the rail. If an electrical consuming device is attached to the transport hanger, current is supplied to it via a suspension cable which is fastened at intervals to cable wagons which can also be moved back and forth along the rail.

Conveying systems are also known comprised of a trolley which can travel back and forth along a double T-girder. Trolley wires are placed beside the T-girder to supply the trolley with current. Sliding contacts of a trolley carriage, which is connected to the trolley via a cam, are engaged with the trolley wires.

The disadvantage of these known systems is that they are not suitable for assembly lines in which a transport hanger can travel back and forth along a rail. The hanger conveying an article which is to be worked by means of an electrically operated tool should also be transportable along the rail.

It is an object of the present invention to provide the conveying system such that it is suitable for the above-mentioned assembly lines.

SUMMARY OF THE INVENTION

Such a system is provided in accordance with an embodiment of the invention which is a conveying system comprised of a rail and at least one transport hanger which can travel back and forth along the rail on rollers, the rollers having horizontal axes of rotation, and the rail having horizontal conveyer support projections which are located at the bottom of the rail and along which the rollers are positioned for travel back and forth along the rail carrying the transport hanger with them, trolley wires which are insulated from one another being located on the rail to the side of the path of motion of the transport hanger, the rail having guideways for rollers of a trolley carriage at the side of the path of motion of the transport hanger for facilitating support and movement of the trolley carriage back and forth at the side of the transport hanger and independently thereof, the trolley carriage having sliding contacts for engagement of the trolley wires for powering a tool that may be carried by the trolley carriage.

An embodiment of the invention is described in greater detail below, with reference to the drawings, in which:

DETAILED DESCRIPTION OF AN EMBODIMENT OF THE INVENTION

Figure 2:
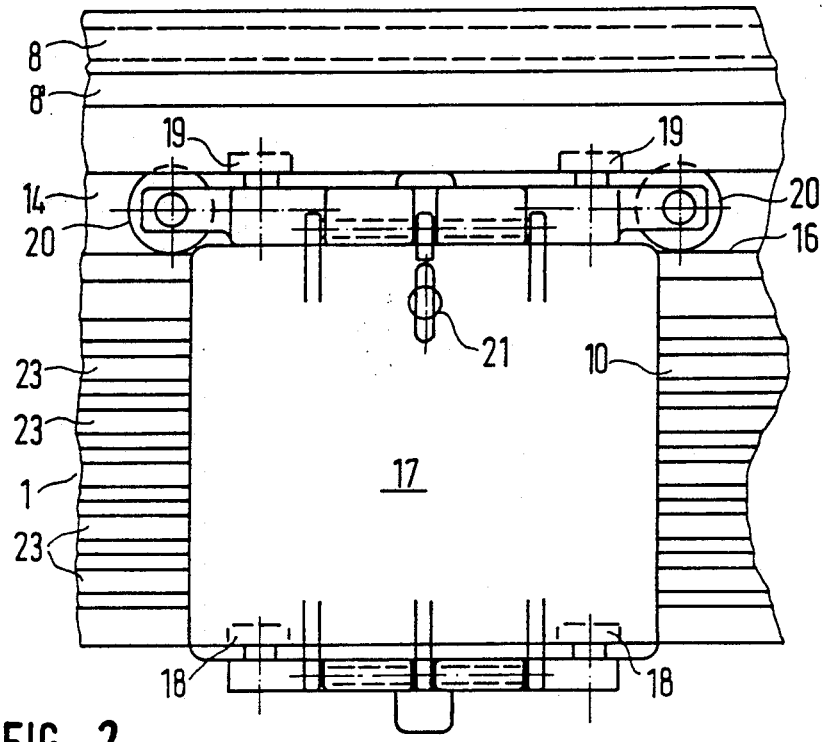
FIG. 2 is a side view of the rail and trolley carriage.
Figure 1:
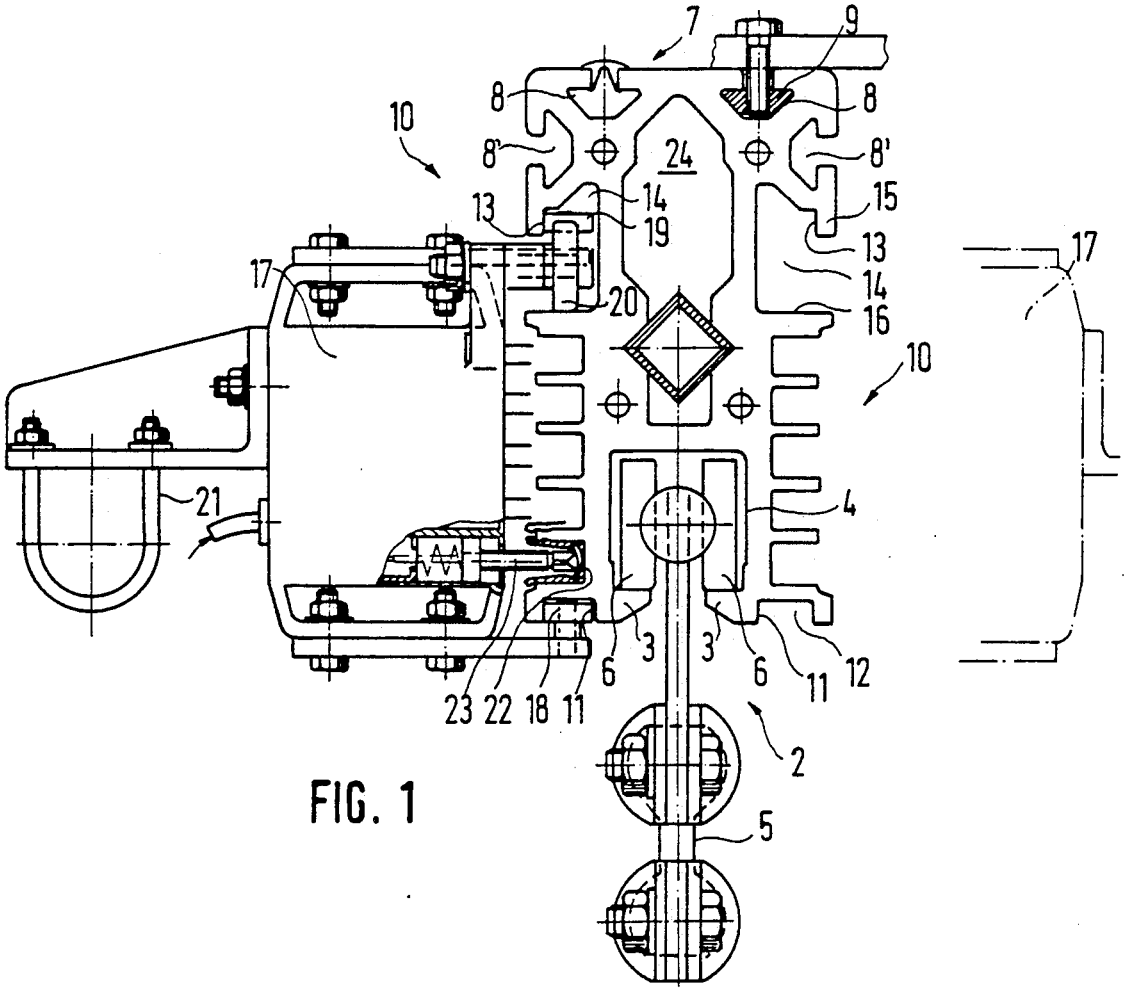
FIG. 1 is a section through a conveying system rail with a view of the transport hanger and the trolley carriage.

Rail 1, essentially rectangular in cross-section, has two horizontal conveyer support projections 3 on its underside 2, the projections being part of a C-shaped recess 4. The C-shaped recess 4 with the two horizontal conveyer belt projections 3 corresponding to the above-noted C-rail. A transport hanger 5 is supported with its rollers 6 by the conveyer projections 3 and can travel back and forth along these projections 3 using the rollers 6.

On its top side 7, rail 1 has two dovetailed grooves 8 which extend along rail 1. Anchors 9, which each have at least one tapped hole, can be inserted into these grooves 8. Via the tapped holes, rail 1 can be screwed by means of a clamping bolt to a girder extending over its top. In the upper area of the vertical sides 10 of rail 1, two further dovetailed grooves 8' are provided; one of the grooves 8' can, for example, be used for fastening the rail to a vertical girder. In this way, it is possible to fasten rail 1 to a girder either at the top or at the side.

A lower vertical support track 11 which is part of a U-shaped recess 12, is provided on the bottom 2 of rail 1 on the side of each of projections 3. Below each of grooves 8', an upper vertically extending support track 13 is provided which is part of a C-shaped recess 14. This upper support track 13 is formed by a vertically extending flank 15 of recess 14. Whereas the lower support track 11 always faces the outside of rail 1, the upper support track 13 always faces toward the inside of rail 1. The bottom of recess 14 is formed by a horizontally extending conveyer support 16 which extends at right angles to support track 13.

A trolley carriage 17 has a lower track-supporting roller pair 18 and an upper track-supporting roller pair 19 which each have a vertical axis of rotation. The lower track-supporting roller pair 18 abuts against supporting track 11, while the upper track-supporting roller pair 19 rests against supporting track 13. Moreover, two bearing rollers 20 with horizontal axes of rotation, which ride on the conveyer support 16, are supported on trolley carriage 17. Trolley carriage 17 is thus supported by bearing rollers 20 which can travel back and forth along conveyer support 16. The trolley carriage is secured against overturning by track-supporting rollers 18, 19 together with support tracks 11, 13.

An overhead supporting device 21 is fastened to trolley carriage 17.

Several trolley wires 22, which are insulated from one another and are separated by ribs, are placed in the region between the bottom 2 and rail 1 and the rib forming conveyer support 16. In the illustrated embodiment, five sliding surfaces can be provided per side 10. Sliding contacts 23 of trolley carriage 17 are engaged with these sliding surfaces.

The transport hanger 5 which carries, for example, an article to be worked can thus travel back and forth along rail 1. A trolley carriage 17 can, moreover, travel back and forth along rail 1 independently of transport hanger 5, on which a tool can be conveyed via the overhead supporting device 21, the tool being supplied with current via trolley wires 22 and sliding contacts 23. Since rail 1 is constructed mirror-symmetrically relative to its vertical axis, it is possible to be able to move the trolley carriage 17 back and forth either on the left or right side of rail 1.

Figure 5:
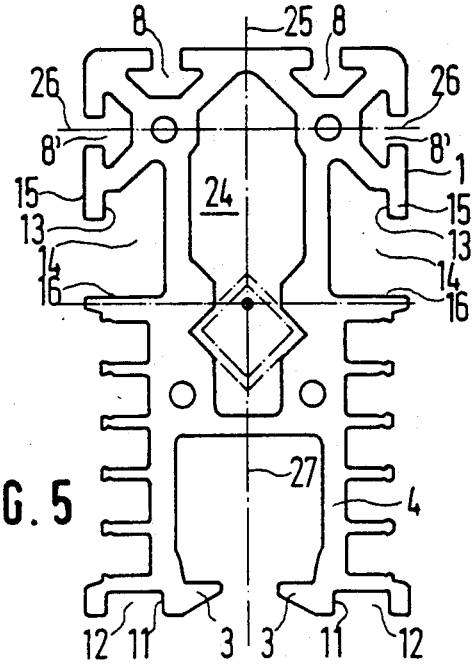
FIG. 5 is a further section through the rail for illustrating the connection possibilities for compressed air connections.

Rail 1 is hollow on the inside. Hollow 24 is supplied with compressed air. To remove the compressed air, rail 1 is drilled so that the bores extend to hollow 24. Standard compressed-air connections are then screwed into the bores. The bores can be located on the rail top 7 at 25 (FIG. 5) or on the vertical side area of grooves 8' at 26. If a rail portion is not traversed by a transport hanger 5, then it is also possible to provide a bore at 27 in the area of recess 4.

The compressed-air connections are used to supply tools operated by compressed air. However, other gases such as protective gas can be used.

Figure 4:
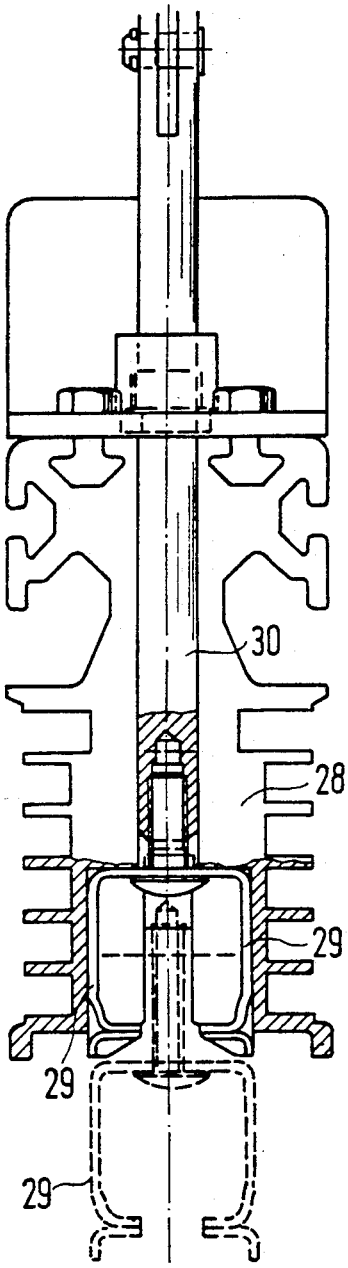
FIG. 4 is a front view toward the rail end with the incoming and outgoing station.
Figure 3:
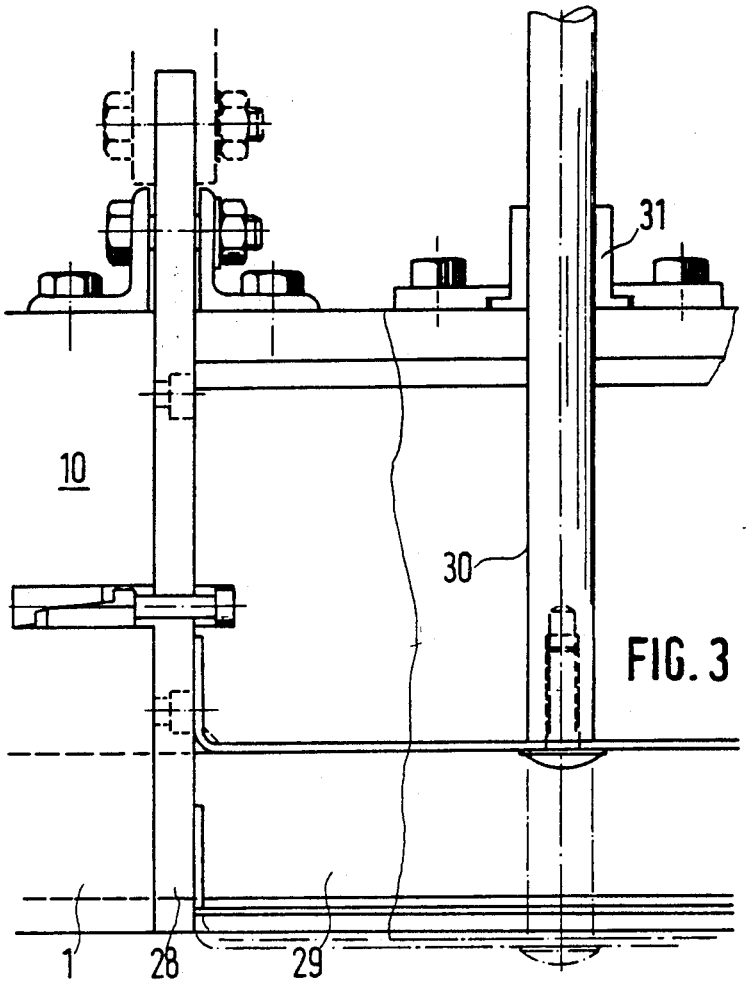
FIG. 3 is a side view of a rail end with an incoming and outgoing station for the transport hangers.

A mounting plate 28, which seals hollow 24, is disposed against each of the ends of the rail (see FIG. 3 and 4). In order to be able to move the transport hangers into and out of rail 1, a C-rail 29 is fastened to the mounting plate 28, the inner profile of which corresponds to the profile of recess 4 with projections 3 and which aligns with this profile. The end of rail 29 can be lowered and raised, the lowered position being shown in dashed lines in FIG. 4. A guide bolt 30, which is guided vertically in a guide 31, is fastened to the end of the rail 29, whereby the guide bolt 30 can, for example, be raised or lowered by a pneumatic cylinder. In the lowered state, rollers 6 are inserted into C-rails 29 and rail 29 is then raised, as a result of which transport hanger 5 can be inserted into rail 1.

We claim:

1. A conveying system comprised of a rail and at least one transport hanger which can travel back and forth along the rail on rollers, the rollers having horizontal axes of rotation, the rail having horizontal conveyer support projections which are located at the bottom of the rail and along which the rollers are positioned for travel back and forth along the rail carrying the transport hanger with them, trolley wires which are insulated from one another being located on the rail offset to one of either side of the path of motion of the transport carriage offset to said one side of the path of motion of the transport hanger for facilitating support and movement of the trolley carriage back and forth to the one side of the transport hanger and independently thereof, the trolley carriage having sliding contacts for engagement of the trolley wires for powering a tool that may be carried by the trolley carriage.

2. A conveying device as defined in claim 1, in which the rail is hollow and has gas connections to the hollow.

3. A conveying device as defined in claim 1, in which the rail has a rectangular profile, the trolley wires being located at a vertical side along which the trolley carriage can be moved.

4. A conveying device according to claim 3, in which the guideways are comprised of at least one horizontal conveyer support and two vertical support tracks extending vertically spaced from one another, at least one trolley carriage roller having a horizontal axis of rotation being moveable back and forth long the conveyer support, trolley carriage rollers having vertical axes of rotation being moveable back and forth along the vertical support tracks, a lower vertical support track facing in the direction of the trolley carriage and an upper support track facing in the direction opposite thereto.

5. A conveying device as defined in claim 4, in which an overhead supporting device is supported by the trolley carriage.

6. A conveying device as defined in claim 4, in which the lower vertical support track extends along the bottom of the rail, the trolley wires being located between the upper and lower vertical support track, the rail having a recess above the trolley wires which encompasses a horizontal flank serving as a conveyer support and a vertical flank serving as the upper vertical support track, the trolley carriage roller having a horizontal axis of rotation and the vertical support rollers being located in the region of the recess.

7. A conveying device as defined in one of claims 1, 2, 4 or 6, in which the upper side of the rail contains at least one dovetailed groove which extends along the rail and in which anchors are contained, the anchors containing mounting bores.

8. A conveying device as defined in claim 7, in which the vertical side of the rail contains an additional dovetailed groove above the recess.

9. A conveying device as defined in claim 2, in which the hollow is oblong and extends from the top of the rail to at least the region of the trolley wires.

10. A conveying device as defined in claim 1, in which the conveyer support projections are formed by a C-shaped recess.

11. A conveying device as defined in one of claims 2, 4, 6 or 10, in which gas connection bores are located randomly in an upper side of the rail.

12. A conveying device as defined in claim 10, in which a mounting plate is disposed at the end of the rail for sealing the hollow, the rail having a C-shaped cross-section and being fastened to the mounting plate aligning with the C-shaped recess, and having a free end which can be lowered.

13. A conveying device as defined in one of claims 1, 2, 4, 6 or 12, in which the rail is axially symmetrical relative to its vertical axis.

14. A conveying device as defined in claim 2, in which the rail has a rectangular profile, the trolley wires being located at a vertical side along which the trolley carriage can be moved.

15. A conveying device according to claim 14, in which the guideways are comprised of at least one horizontal conveyer support and two vertical support tracks extending vertically spaced from one another, at least one trolley carriage roller having a horizontal axis of rotation being moveable back and forth along the conveyer support, trolley carriage rollers having vertical axes of rotation being moveable back and forth along the vertical support tracks, a lower vertical support track facing in the direction of the trolley carriage and an upper support track facing in the direction opposite thereto.

* * * * *

UNITED STATES PATENT AND TRADEMARK OFFICE

CERTIFICATE OF CORRECTION

PATENT NO. : 5,012,746

DATED : May 7, 1991

INVENTOR(S) : Uwe Bormann et al

It is certified that error appears in the above-identified patent and that said Letters Patent is hereby corrected as shown below:

Column 3, line 41, prior to "carriage" insert --hanger, the rail having guideways for rollers of a--.

Signed and Sealed this

Nineteenth Day of January, 1993

*Attest:*

*Attesting Officer*

DOUGLAS B. COMER

*Acting Commissioner of Patents and Trademarks*